United States Patent [19]

Fowlkes

[11] 3,933,669

[45] Jan. 20, 1976

[54] FUNCTIONAL FLUID COMPOSITIONS

[75] Inventor: Paul D. Fowlkes, Glen Ellyn, Ill.

[73] Assignee: Monsanto Company, St. Louis, Mo.

[22] Filed: Dec. 23, 1974

[21] Appl. No.: 535,328

Related U.S. Application Data

[63] Continuation-in-part of Ser. No. 406,422, Oct. 15, 1973, abandoned.

[52] U.S. Cl. ..... 252/78; 252/73

[51] Int. Cl.[2] ..... C10M 1/46; C10M 3/40

[58] Field of Search ..... 252/78, 73, 49.8, 59

[56] References Cited

UNITED STATES PATENTS 2,231,248 2/1941 Bowden ..... 252/59

3,723,315 3/1973 Sullivan ..... 252/49.8

OTHER PUBLICATIONS

Blake et al., "Chemical Abstracts," Vol. 55 (1961), p. 19741.

Egan, "Lubrication Engineering" Feb.–Mar. (1947), pp. 24–26.

*Primary Examiner*—Harris A. Pitlick
*Attorney, Agent, or Firm*—Herbert B. Roberts

[57] ABSTRACT

Functional fluid compositions containing phosphate ester base stocks and hydrogenated quaterphenyls.

4 Claims, No Drawings

FUNCTIONAL FLUID COMPOSITIONS

BACKGROUND OF THE INVENTION

This is a continuation-in-part of Applicant's co-pending application Ser. No. 406,422 filed Oct. 15, 1973 and now abandoned.

1. Field of the Invention

This invention relates to functional fluid compositions containing phosphate ester base stocks and hydrogenated quaterphenyls and to the use of such fluids in hydraulic pressure devices.

2. Description of the Prior Art

Functional fluids suitable for operating hydraulic mechanisms require a combination of properties. These include a low pour point to insure safe and satisfactory low temperature operations and low oxidative susceptibility to avoid sludge build-up. Another important property is a flat viscosity temperature curve, that is, a high viscosity index which allows the fluid to remain operable over a wide range of temperatures. One of the vital properties required for industrial, mining or military uses is fire resistance. Still other desirable properties include a relatively high boiling point and low corrosive characteristics.

As mentioned, fire resistance is an important property of fluids, especially those used in mining operations and hydraulic-powered hand tools. To be acceptable fluids for these uses, they must pass the Schedule 30 U.S. Bureau of Mines Fire Test. Various phosphate ester base fluids and particularly mixtures of triaryl phosphates where the aryl groups are phenol, alkyl substituted phenols and aryl alkyl substituted phenols provide considerably more fire resistance than the Schedule 30 Test requires, but cost generally six times that of petroleum fluids, require special sealing materials and are often unstable at low temperatures. A functional fluid composition providing satisfactory fire resistance for mining and hydraulic-powered hand tool operations as well as other desirable fluid properties, would be an advancement in the art.

SUMMARY OF THE INVENTION

In accordance with this invention, there is provided fire resistant functional fluid compositions useful in the mining operations. These compositions comprise at least one phosphate ester of the general formula

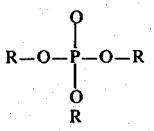

FORMULA I wherein each R is individually an alkyl group containing from 2 to 12 carbon atoms, an alkoxy alkyl group, containing from 2 to 12 carbon atoms in the alkyl group; phenyl; alkyl substituted phenyl group having the general structure

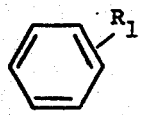

FORMULA II wherein $R_1$ is an alkyl radical of 1 to 18 carbon atoms; or an aryl alkyl phenyl group having the general structure

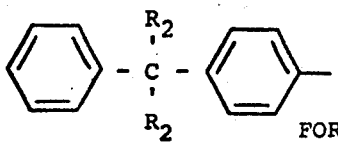

FORMULA III wherein each $R_2$ is individually an alkyl of 1 to about 18 carbon atoms or hydrogen, and 10% to about 50% based on the total weight of the composition, of hydrogenated quaterphenyl, 25 to 50% hydrogenated.

Surprisingly, in addition to providing sufficient fire resistance, these fluids have an unexpectedly low pour point and remain clear homogeneous solutions down to the pour point temperature of −23°C, which minimizes outdoor storage problems.

Another aspect of this invention provides a method for using such fluids in hydraulic pressure devices.

The hydrogenated quaterphenyls that may be used in the practice of this invention are 25 to 50%, preferably 30 to 40% hydrogenated. They are described and may be prepared in accordance with the teachings of U.S. Pat. No. 2,925,398 which is incorporated herein by reference.

About 10% to about 50%, preferably 35% to 45% by weight of hydrogenated quaterphenyl, based on the total weight of the composition of this invention, is used. This amount, as well as the hydrogenation level, are very critical. If more than 50% is utilized, the fire resistance suffers. If less than 10% is used, generally highly aromatic phosphate esters solidify at low temperatures. Likewise, if a different hydrogenation level is employed, the composition solidifies at low temperatures. Applicant has also found that other polyphenyls, namely bi and terphenyls interfere with fire resistance.

A portion of the hydrogenated quaterphenyl may be replaced with petroleum derived hydrocarbon oils. Such oils may be used to replace a portion of the hydrogenated quaterphenyl in an amount of about 5% to about 80% based on the total weight of the hydrogenated quaterphenyl. Generally, a portion of the quaterphenyl is replaced with petroleum oils in those applications where low temperature homogeneity is not important.

In those instances where a portion of the quaterphenyl is replaced with petroleum derived hydrocarbon oils, the quaterphenyl acts as a solubilizer for the highly aromatic phosphate esters which would be insoluble in petroleum oil. Such a composition is also advantageous in that it can be separated, recovered and reclaimed in cases of leaks.

As mentioned, esters of phosphoric acid which can be employed as base stocks in the compositions of the instant invention are defined by Formula I. Preferred base stocks are hereinafter referred to generically as phosphates and include trialkyl phosphates, triphenyl phosphates, alkyl-substituted phenyl phosphates, aryl alkyl-substituted phenyl phosphates and mixtures thereof. When R is an alkyl group, preferably it contains from 2 to 12 carbon atoms. When each R is an alkyl group, the total number of carbon atoms in the trialkyl phosphate is from 12 to 36 carbon atoms. These alkyl groups are for example, ethyl, propyl, isopropyl, butyl, hexyl, 2-ethylhexyl, dodecyl, decyl and the like. When R is an alkyl-substituted phenyl group, the alkyl group contains 1 to 18 carbon atoms provided that the total number of carbon atoms in all alkyl groups attached to any one phenyl group is at most, 18 carbon atoms. Illustrative of these alkyl-substituted phenyl groups are for example, methylphenyl, ethylphenyl, dimethylpropylphenyl, nonylphenyl, decylphenyl, dipentylphenyl, butylhexylphenyl, and the like. Alkoxyalkyl groups for example, those having the formula $$H(C_nH_{2n}-O)_x-C_aH_{2a}$$

wherein n is an integer having a value of from 1 to 10, a is an integer having a value of from 2 to 10, preferably x is 1. These alkoxyalkyl groups are for example, methoxyethyl, ethoxyethyl, propoxyethyl, ethoxypropyl, ethoxypentyl, propoxydecyl, nonyloxyethyl, octyloxybutyl and the like.

Aryl alkyl phenyl groups represented by Formula III are those wherein each $R_2$ is individually hydrogen or an alkyl of 1 to about 18, preferably 1 to 6, carbon atoms. Illustrative of these are for example, cumylphenyl, benzylphenyl, alphamethylbenzyl, alpha-hexylbenzyl, alpha, alpha-dinonylbenzyl, alpha, alpha-dipentadecylbenzyl and alpha-heptadecylbenzyl.

Typical examples of these phosphate esters are for example, dibutylphenyl phosphate, triphenyl phosphate, tricresyl phosphate, tributyl phosphate, tri-2-ethylhexyl phosphate, trioctyl phosphate, the phosphates described in U.S. Pat. No. 3,723,315 which is incorporated herein by reference, such as di(nonylphenyl) phenyl phosphate, di(cumylphenyl) phenyl phosphate, (cumylphenyl) (nonylphenyl) phenyl phosphate, and mixtures of the above phosphates such as mixtures of tributyl phosphate and tricresyl phosphate, mixtures of triphenyl phosphate and 2-ethylhexyl diphenyl phosphate, mixtures of cumylphenyl diphenyl phosphate, nonylphenyl diphenyl phosphate, 2-ethylhexyl diphenyl phosphate and triphenyl phosphate. A preferred mixture contains 45 to 65% triphenyl phosphate, 25 to 45% by weight of the reaction product of 1.5 to 2 moles of nonylphenyl, 0.5 to 1 mole of cumylphenol, 6 to 7 moles of phenyl with 3 moles of phosphorus oxychloride and 5 to 15% of 2-ethylhexyl diphenyl phosphate. All percentages are by weight based on the total weight of the mixture. These esters are well known and can be prepared by those procedures well known in the art.

In the compositions of this invention, the phosphate ester is present in an amount of from about 50% to about 90%, preferably 50% to 65% by weight, based on the total weight of the composition.

The compositions of the present invention can be prepared by methods known to those skilled in the art. For example, the phosphate ester and the hydrogenated quaterphenyl can be blended in stainless steel equipment using a propeller stirrer until a uniform mixture is obtained.

Functional fluid compositions of this invention can contain dyes, pour point depressants, metal deactivators, acid scavengers, rust inhibitors, defoamers, viscosity index improving antioxidants, load bearing additives and the like. They are generally used in small amounts, usually less than 5% by weight, based on the total weight of the fluid composition.

Examples of viscosity index improvers include styrene isobutylene copolymers, styrene butadiene copolymers having an average molecular weight of about 60,000 to 100,000 and polypropylene glycol having an average molecular weight of 2000 to 5000. Rust inhibitors include sulfonate soaps such as barium nonylnapthyl sulfonate, and salts of fatty acids such as calcium phenyl sterate. And scavengers include hindered phenols, amines and epoxy compounds. Foam inhibitors include polymerized silicone fluids. Phthalate and adipate esters may also be used.

An illustrative composition of this invention contains:

| Ingredient | Amount-Percent by Weight |
|---|---|
| quaterphenyl - 40% hydrogenated | 40 |
| triphenyl phosphate | 30 |
| 2-ethylhexyl diphenyl phosphate | 10 |
| nonylphenyl diphenyl phosphate-cumylphenyl diphenyl phosphate mixture | 20 |

*Prepared by reacting two moles of nonylphenol, one mole of cumylphenol, six moles of phenol and three moles of phosphorus oxychloride.

Other compositions of this invention contain in the same amount in place of the quaterphenyl, quaterphenyl—45% hydrogenated, quaterphenyl—28% hydrogenated and quaterphenyl—30% hydrogenated. Alternatively, in place of the 2-ethylhexyl diphenyl phosphate, there may be substituted in the same amount cresyl diphenyl phosphate, hexyl diphenyl phosphate, octyldiphenyl phosphate or pentadiphenyl phosphate. Up to 10% of the nonylphenyl diphenyl phosphate — cumylphenyl diphenyl phosphate mixture may be replaced with octylbenzyl phthalate, di isodecyl adipate, polypropylene glycol, phthalate esters with $C_7$ to $C_{11}$ alcohols and styrene isobutylene copolymers.

The method of this invention involves using the fluid compositions of this invention as the hydraulic fluid in a method of operating a hydraulic pressure device, wherein a displaceable force is transmitted to a transplaceable member by means of a hydraulic fluid.

Another method of this invention involves using the fluid composition of this invention in a method of lubricating metal surfaces in frictional contact by interposing between the surfaces such fluid composition.

Examples

The following examples serve to better illustrate the invention. All are parts by weight unless otherwise expressly set forth.

The compositions in Table I were prepared by blending the ingredients until a uniform mixture was formed.

TABLE I

| | INGREDIENTS - PERCENT BY WEIGHT | | | | | | | | |
|---|---|---|---|---|---|---|---|---|---|
| Example Number | Quaterphenyl 40%-hydrogenated | TPP[1] | $N_2C$[2] | 2-ethylhexyl diphenyl phosphate | cresyl diphenyl phosphate | Oil | Phthalate[3] Ester | DIDA[4] | VI improver[5] anti oxidant and/or anti foam agent |
| 1 | 40 | 30 | 17 | 10 | — | — | 2.7 | — | .3 |
| 2 | 40 | 30 | 21.6 | 5 | — | — | 2.7 | — | .7 |
| 3 | 30 | 30 | 24 | 13 | — | — | 2.7 | — | .3 |
| 4 | 30 | 30 | 25 | 12 | — | — | 2.7 | — | .3 |

TABLE I-continued

| Example Number | Quaterphenyl 40%-hydrogenated | TPP[1] | $N_2C$[2] | 2-ethylhexyl diphenyl phosphate | cresyl diphenyl phosphate | Oil | Phthalate[3] Ester | DIDA[4] | VI improver[5] anti oxidant and/or anti foam agent |
|---|---|---|---|---|---|---|---|---|---|
| | INGREDIENTS - PERCENT BY WEIGHT | | | | | | | | |
| 5 | 40 | 27 | 15 | — | 15 | — | 2.7 | — | .3 |
| 6 | 40 | 30 | 14 | — | 13 | — | 2.7 | — | .3 |
| 7 | 31 | 35 | 20 | — | 0 | — | 13.6 | — | .4 |
| 8 | 40 | 33 | 17 | 7 | — | — | 2.7 | — | .3 |
| 9 | 35 | 35 | 20 | — | — | 10 | — | — | — |
| 10 | 30 | 35 | 25 | — | — | — | — | 10 | — |
| 11 | 35 | 35 | 25 | — | — | — | — | 5 | — |
| 12 | 40 | 36 | 24 | — | — | — | — | — | — |
| 13 | 40 | 37 | 23 | — | — | — | — | — | — |
| 14 | 37 | 35 | 20 | — | — | — | 2.7 | 5 | .3 |
| 15 | 35 | 35 | 20 | — | — | — | — | 10 | — |
| 16 | 40 | 40 | 15 | — | — | — | — | 5 | — |
| 17 | 45 | 45 | 10 | — | — | — | — | — | |
| 18 | 50 | 50 | — | — | — | — | — | — | — |
| 19 | 30 | 30 | 22 | 15 | — | — | 2.7 | — | .3 |
| 20 | 40 | 30 | 20 | 6.8 | — | — | 2.7 | — | .5 |
| 21 | 30 | 30 | 25 | 12 | — | — | 2.7 | — | .3 |
| 22 | 30 | 33 | 21 | 13 | — | — | 2.7 | — | .3 |
| 23 | 37 | 35 | 20 | — | — | — | — | 5.5 | 2.5 |

[1]Triphenyl phosphate
[2]Mixture of phosphate esters prepared by reacting 2 moles of nonylphenol, 1 mole of cumylphenol and 6 moles of phenol with 3 moles of phosphorus oxychloride.
[3]Octylbenzyl phthalate or phthalate ester with $C_7$ $C_{11}$ alcohols.
[4]Di isodecyl adipate
[5]Styrene isobutylene copolymers of polypropylene glycol.

Schedule 30 fire tests were run on some of the compositions and the results are given in Table II below. Viscosity and specific gravity information is also given.

These data show that the disclosed fluids, containing 10 to 50 percent by weight of hydrogenated quaterphenyl within the 25 to 50 weight percent hydrogenation range, produces fire resistant liquids. The other examples result in products which are either liquids with substantially less fire resistance, liquids which have such high viscosity as to be of no practical use as hydraulic fluids, liquids which contain crystals, or slurrys.

TABLE II

| Example Number | Wick | SPRAY Torch* | SPRAY Kerosine* | SPRAY Spark | AIT °C | Flash °C | Fire °C | Viscosity[1] 38°C | Viscosity[1] 99°C | SPG[2] |
|---|---|---|---|---|---|---|---|---|---|---|
| 1. | 27.0 | <1-1 | <1-1 | — | — | 246 | 274 | 66.5 | 6.83 | 1.098 |
| 2. | — | — | — | — | 426 | — | — | — | — | — |
| 3. | — | <1-2 | <1-2 | — | 426 | — | — | — | — | — |
| 4. | — | — | — | — | — | — | — | 50.1 | — | — |
| 5. | — | <1-1 | <1-1 | — | — | — | — | 69.1 | 6.90 | 1.107 |
| 6. | — | <1-1 | <1-1 | <1-1 | — | 243 | 296 | — | — | — |
| 7. | 27.6 | 1-3 | 1-2 | <1 | — | — | — | — | — | — |
| 8. | 27.0 | — | — | — | — | — | — | 67.7 | — | — |
| 9. | — | — | — | — | — | — | — | — | — | — |
| 10. | — | — | — | — | — | — | — | 46.7 | — | — |
| 11. | — | — | — | — | — | — | — | 57.8 | — | — |
| 12. | — | — | — | — | — | — | — | 70.9 | 6.42 | — |
| 13. | — | — | — | — | — | — | — | — | — | 1.112 |
| 14. | — | — | — | — | — | — | — | 68.3 | 7.05 | — |
| 15. | — | — | — | — | — | — | — | 49.2 | 5.67 | — |
| 16. | — | — | — | — | — | — | — | — | — | — |
| 17. | — | — | — | — | — | — | — | — | — | — |
| 18. | — | — | — | — | — | — | — | — | — | — |
| 19. | — | — | — | — | — | — | — | 49.6 | — | — |
| 20. | — | — | — | — | 460 | 246 | 274 | 68 | 6.8 | — |
| 21. | — | — | — | — | — | — | — | 54.3 | — | — |
| 22. | — | — | — | — | — | 248 | 299 | 48.6 | — | 1.109 |
| 23. | 33.4 | <1-1 | <1-1 | — | — | 248 | 299 | 66.3 | 6.75 | — |

*In seconds
[1]In centistokes
[2]Specofoc gravity

Tables III and IV further demonstrate the effectiveness of hydrogenated quaterphenyl in improving fire resistance in the disclosed compositions. Table III shows the compositions of examples 24 through 32, while Table IV shows the fire resistance and physical properties of the compositions of Table III.

TABLE III

| Ex. No. | Triphenyl Phosphate | $N_2C$ Phosphate | 2-ethylhexyl Diphenyl Phosphate | Phthalate Ester | VI Improver Additives | HQ-40[(1)] | HQ-100[(2)] | HB-40 (3) | Biphenyl | Terphenyl |
|---|---|---|---|---|---|---|---|---|---|---|
| | INGREDIENTS, PERCENT BY WEIGHT | | | | | | | | | |
| 24 | 30 | 20.2 | 6.8 | 2.7 | 0.3 | 40 | 0 | 0 | 0 | 0 |
| 25 | 30 | 20.2 | 6.8 | 2.7 | 0.3 | 0 | 0 | 0 | 40 | 0 |
| 26 | 30 | 20.2 | 6.8 | 2.7 | 0.3 | 0 | 0 | 0 | 0 | 40 |
| 27 | 30 | 20.2 | 6.8 | 2.7 | 0.3 | 0 | 0 | 40 | 0 | 0 |
| 28 | 12 | 8.2 | 6.8 | 2.7 | 0.3 | 70 | 0 | 0 | 0 | 0 |

TABLE III-continued

| Ex. No. | Tri-phenyl Phos-phate | $N_2C$ Phos-phate | 2-ethyl-hexyl Diphenyl Phosphate | Phthalate Ester | VI Improver Additives | HQ-40[1] | HQ-100[2] | HB-40 (3) | Biphenyl | Terphenyl |
|---|---|---|---|---|---|---|---|---|---|---|
| | INGREDIENTS, PERCENT BY WEIGHT | | | | | | | | | |
| 29 | 30 | 20.2 | 6.8 | 2.7 | 0.3 | 0 | 40 | 0 | 0 | 0 |
| 30 | 46 | 31 | 10.4 | 4.14 | 0.46 | 8 | 0 | 0 | 0 | 0 |
| 31 | 42.5 | 28.6 | 9.6 | 3.87 | 0.43 | 15 | 0 | 0 | 0 | 0 |
| 32 | 50 | 38 | 12 | 0 | 0 | 0 | 0 | 0 | 0 | 0 |

[1]40% Hydrogenated Quaterphenyl
[2]100% Hydrogenated Quaterphenyl
[3]40% Hydrogenated Terphenyl

TABLE IV

| EXAMPLE NUMBER | FIRE RESISTANCE PROPERTIES: Wick, Avg. cycles to burn[1] | Spray Torch Ignition[2] | Flash Point °C.[3] | Fire Point °C.[3] | PHYSICAL PROPERTIES: Appearance | Solution Point °C. | Viscosity, cs. 38°C. | 99°C. |
|---|---|---|---|---|---|---|---|---|
| 24 | 21.6 | <1 – 1 sec. | 249 | 282 | liquid at 25 C | <25 C | 69 | 7 |
| 25 | 3.6 | >10 sec. | 138 | 143 | nearly solid crystalline slurry | 49 to 54 C | — | — |
| 26 | 36 | [4] | 221 | 268 | Thick slurry of solids and liquid | 127 to 132 C | — | — |
| 27 | 9.8 | >10 sec | 201 | 238 | liquid at 25 C | <25 C | 27 | 4 |
| 28 | 16.6 | [5] | 243 | 271 | viscous liquid at 25 C | <25 C | 194 | 10 |
| 29 | — | — | — | — | thin slurry at 25 C | 60 to 65 C | — | — |
| 30 | 26.0 | 1> – 4 | 249 | 274 | some crystal growth at 31°C | — | 27.8 | 4.81 |
| 31 | 21.4 | 1 – 6 | 238 | 277 | no change in seed crystals | — | 34.5 | 52.5 |
| 32 | — | — | — | — | solids/liquid slurry at 25 C | 32 to 38 C | — | — |

[1]BuMines Sched. 30, fluid not subjected to evaporation as for water containing fluids
[2]BuMines Sched. 30, torch sequence generally more severe than spark or burning rag ignition source.
[3]ASTM D-92, Cleveland open cup
[4]Could not spray at 150 F (~65 C) test temp. due to solids present
[5]High viscosity would not allow spray pattern from test nozzle at required test temp. and pressure.

From a consideration of the above specification, it will be appreciated that many improvements and modifications may be made without departing from the spirit and scope of the invention. It is to be understood, therefore, that the invention is in no way limited except as defined by the appended claims.

What is claimed is:

1. A functional fluid composition comprising (1) from about 10% to about 50% by weight based on the total weight of the composition, of a phosphate ester represented by the formula

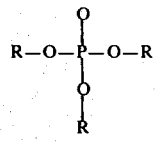

wherein each R is individually an alkyl group containing from 2 to 12 carbon atoms; an alkoxy alkyl group, containing from 2 to 12 carbon atoms in the alkyl group; phenyl; alkyl substituted phenyl group having the general structure

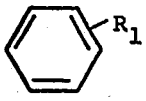

wherein $R_1$ is an alkyl radical of 1 to 18 carbon atoms; or an aryl alkyl phenyl group having the general structure and

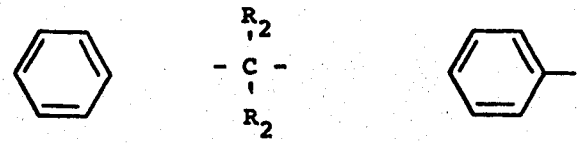

wherein each $R_2$ is individually an alkyl of 1 to about 18 carbon atoms, and (2) 10% to about 50% by weight based on the total weight of the composition, of hydrogenated quaterphenyl, 25 to 50% hydrogenated.

2. A composition according to claim 1 wherein the phosphate ester is selected from the group consisting of tributyl phosphate, tricresyl phosphate, cresylidene diphenyl phosphate, triphenyl phosphate, cumylphenyl diphenyl phosphate, nonylphenyl diphenyl phosphate, 2-ethylhexyl diphenyl phosphate, cresyl diphenyl phosphate and mixtures thereof.

3. A composition according to claim 2 wherein 5% to about 80% of the hydrogenated quaterphenyl is replaced with a petroleum derived hydrocarbon oil.

4. A fluid composition consisting essentially of (1) from about 10% to about 50% by weight, based on the total weight of the composition, of a mixture of triphenyl phosphate, nonylphenyl diphenyl phosphate, cumylphenyl diphenyl phosphate, and 2-ethylhexyl diphenyl phosphate; and (2) 10 to 50% by weight, based on the total weight of the composition, of hydrogenated quaterphenyl 30 to 40% hydrogenated.

* * * * *

UNITED STATES PATENT OFFICE

CERTIFICATE OF CORRECTION

PATENT NO. : 3,933,669

DATED : January 20, 1976

INVENTOR(S) : Paul D. Fowlkes

It is certified that error appears in the above-identified patent and that said Letters Patent are hereby corrected as shown below:

Col. 3, line 44, "phenyl" should be -- phenol -- .

Cols. 5 and 6, footnote 3 under Table I reads "$C_7$ $C_{11}$"

should be -- $C_7$ to $C_{11}$ -- .

Cols. 5 and 6, footnote 2 under Table II reads "Specofoc gravity"

should be -- Specific gravity -- .

Col. 7, formula in Claim 1 reads:

```
          O
          '
R - O - P - O - R
          '
          O
          '
          R
```

should be --

```
          O
          "
R - O - P - O - R
          '
          O
          '
          R .
```

UNITED STATES PATENT OFFICE

CERTIFICATE OF CORRECTION

PATENT NO. : 3,933,669

DATED : January 20, 1976

INVENTOR(S) : Paul D. Fowlkes

It is certified that error appears in the above-identified patent and that said Letters Patent are hereby corrected as shown below:

Column 7, line 43, reads "10% to about 50%" and should be
-- 50% to about 90% --

Column 8, line 60, reads "10% to about 50%" and should be
-- 50% to about 90% --

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*